US008496457B2

(12) United States Patent
Varga

(10) Patent No.: US 8,496,457 B2
(45) Date of Patent: Jul. 30, 2013

(54) METERING GEAR PUMP WITH INTEGRAL FLOW INDICATOR

(75) Inventor: Leslie J. Varga, Cumming, GA (US)

(73) Assignee: Nordson Corporation, Westlake, OH (US)

( * ) Notice: Subject to any disclaimer, the term of this patent is extended or adjusted under 35 U.S.C. 154(b) by 175 days.

(21) Appl. No.: 13/285,514

(22) Filed: Oct. 31, 2011

(65) Prior Publication Data

US 2013/0108494 A1 May 2, 2013

(51) Int. Cl.

| | |
|---|---|
| ***F01C 11/00*** | (2006.01) |
| ***F03C 2/00*** | (2006.01) |
| ***F03C 4/00*** | (2006.01) |
| ***F04C 2/00*** | (2006.01) |
| ***F04C 11/00*** | (2006.01) |
| ***F04C 23/00*** | (2006.01) |
| ***F04B 17/00*** | (2006.01) |
| ***F04B 35/04*** | (2006.01) |

(52) U.S. Cl.

USPC ..... 418/200; 418/205; 417/410.4

(58) Field of Classification Search

USPC ..... 417/410.3, 410.4; 418/75, 76, 132, 418/199, 200, 205, 206.1, 206.2

See application file for complete search history.

(56) References Cited

U.S. PATENT DOCUMENTS

| | | | | |
|---|---|---|---|---|
| 4,193,745 | A | 3/1980 | Hamilton et al. | |
| 5,228,594 | A * | 7/1993 | Aslin | 222/63 |
| 5,244,367 | A * | 9/1993 | Aslin | 418/104 |
| 5,829,647 | A | 11/1998 | Miller | |
| 6,759,969 | B2 * | 7/2004 | Lund | 340/870.02 |
| 6,857,860 | B1 * | 2/2005 | Zimmermann et al. | 417/410.4 |
| 7,851,775 | B2 * | 12/2010 | Hoyt et al. | 250/577 |

* cited by examiner

*Primary Examiner* — Peter J Bertheaud

(74) *Attorney, Agent, or Firm* — Wood, Herron & Evans, L.L.P.

(57) ABSTRACT

A gear pump includes a driven gear and an idler gear each mounted for rotation in a housing. The driven gear and the idler gear include respective gear teeth in a meshing relationship and forming an inlet space and an outlet space in the housing and adjacent to the meshing gear teeth. The inlet space is in fluid communication with the inlet port and the outlet space is in fluid communication with the outlet port. A flow indicating element is located in the housing and is mounted for rotation independent of the driven gear and the idler gear. The flow indicating element is configured to be rotated by the viscous fluid to indicate when the fluid is moving from the inlet port and inlet space to the outlet space and outlet port.

14 Claims, 2 Drawing Sheets

METERING GEAR PUMP WITH INTEGRAL FLOW INDICATOR

TECHNICAL FIELD

The present invention generally relates to fluid dispensing apparatus and, more specifically, to metering gear pumps designed to meter highly accurate volumes of viscous fluid in a dispensing system.

BACKGROUND

Metering gear pumps operate by moving viscous fluid between meshing gears. Typically, the gears are mounted within stacked plates which are appropriately ported to receive viscous fluid between the gears and discharge the fluid usually in one or more streams depending on the number of gears and outlet ports. In a simple metering gear pump, there will be a single inlet port and a single outlet port. The inlet port communicates with an inlet space adjacent to the meshing gears and the outlet port communicates with an outlet space between the meshing gears. In the case of external gears, the two meshing gears will create suction drawing the fluid into the inlet space. As the gears rotate, they separate on the inlet side of the pump, creating a void and suction which is filled by the fluid. The fluid is carried by the gears to the discharge or outlet side of the pump, where the meshing of the gears displaces the fluid from the outlet space between the gears and through the outlet port. The mechanical clearances within a gear pump are typically small and these tight clearances, as well as the viscosity of the fluid and gear speed, will force the fluid continually from the inlet side of the pump to the outlet side of the pump.

There may be instances in various applications, including manufacturing operations, in which the gears of a metering gear pump will rotate but fluid will not adequately flow through the pump. In order to ensure that operating personnel are quickly notified in this situation, various measures are taken. For example, one or more flow meters or pressure transducers are used in the fluid system downstream from the pump to provide a monitoring function. If a flow meter or pressure transducer indicates that flow in the system is inadequate, the production line may be shut down for troubleshooting and maintenance purposes.

It would be desirable to provide a simpler and potentially less expensive manner of monitoring proper fluid metering from a gear pump.

SUMMARY

In a first embodiment, a gear pump is provided for metering viscous fluid. The gear pump generally comprises a housing including an inlet port for receiving the viscous fluid and an outlet port for discharging the viscous fluid. The gear pump may be of a simple design and utilize as few as two meshing gears, or may be more complex and utilize more than two gears and/or more than one fluid output stream. At least a first, driven gear and a second, idler gear are each mounted for rotation in the housing. The driven gear and the idler gear include respective gear teeth in a meshing relationship. The gear teeth generally form an inlet space and an outlet space in the housing, each being located adjacent to the meshing gear teeth. The inlet space is in fluid communication with the inlet port and the outlet space is in fluid communication with the outlet port. The gear pump further includes a flow indicating element located in the housing and mounted for rotation independent of the driven gear and the idler gear. The flow indicating element is configured to be rotated by the viscous fluid to indicate when the fluid is moving from the inlet port and inlet space to the outlet space and outlet port.

The gear pump can include various other aspects or illustrative embodiments. For example, an electronic control is coupled to the flow indicating element and is operable to indicate rotation of the flow indicating element to a user. This electronic control could take various forms, and in one embodiment comprises an encoder. The flow indicating element can further comprise a flow indicating gear. The flow indicating gear is preferably mounted for rotation coaxially relative to at least one of the driven gear or the idler gear. In other embodiments, more than one flow indicating element may be provided and these may be respective gears mounted coaxially relative to each of the driven and idler gears. The housing may comprise a plurality of stacked plates. In this case, the driven gear and the idler gear may be mounted for rotation in one of the stacked plates and the flow indicating gear may be mounted in an another of the stacked plates.

A method of indicating flow of viscous fluid through a gear pump is also provided and includes supplying the viscous fluid to an inlet port of a gear pump housing. A first gear is driven in meshing relation with a second gear in the housing. The first and second gears are each mounted for rotation in the housing so as to move the viscous fluid from the inlet port to an inlet space adjacent the meshing first and second gears and then to an outlet space adjacent the meshing first and second gears and an outlet port of the housing. A flow indicating element located in the housing is rotated by movement of the viscous fluid from the inlet port and inlet space to the outlet space and outlet port. Rotation of the flow indicating element may be communicated to a user through an electronic control operatively coupled to the flow indicating element. For example, rotation of the flow indicating element may be suitably communicated to a user through the use of an encoder operatively coupled to the flow indicating element and included as part of the control and an associated user display, such as an electronic display screen. As discussed above, rotating the flow indicating element can preferably comprise rotating a flow indicating gear. More preferably, the flow indicating gear may rotate coaxially relative to at least one of the first, driven gear or the second, idler gear.

Various additional features of the invention will become more readily apparent to those of ordinary skill in the art upon review of the following detailed description of the illustrative embodiments, taken in conjunction with the accompanying drawings.

DETAILED DESCRIPTION

Figure 1:
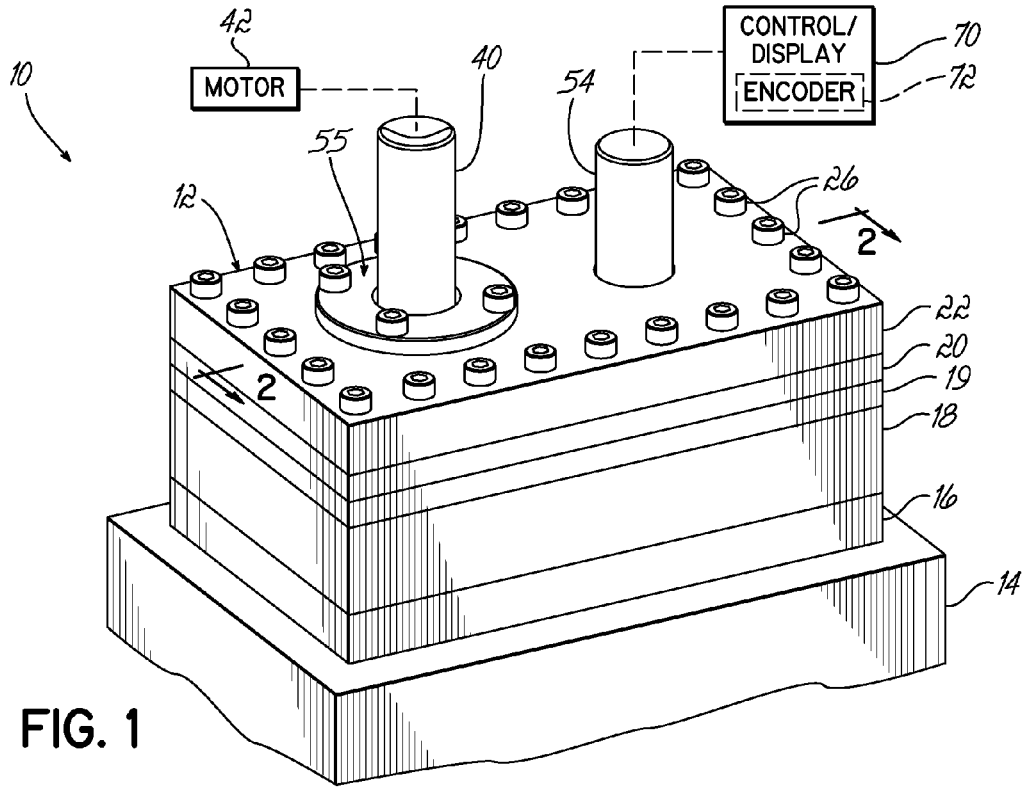
FIG. 1 is a schematic perspective view of a gear pump constructed in accordance with a first illustrative embodiment of the invention.
Figure 2:
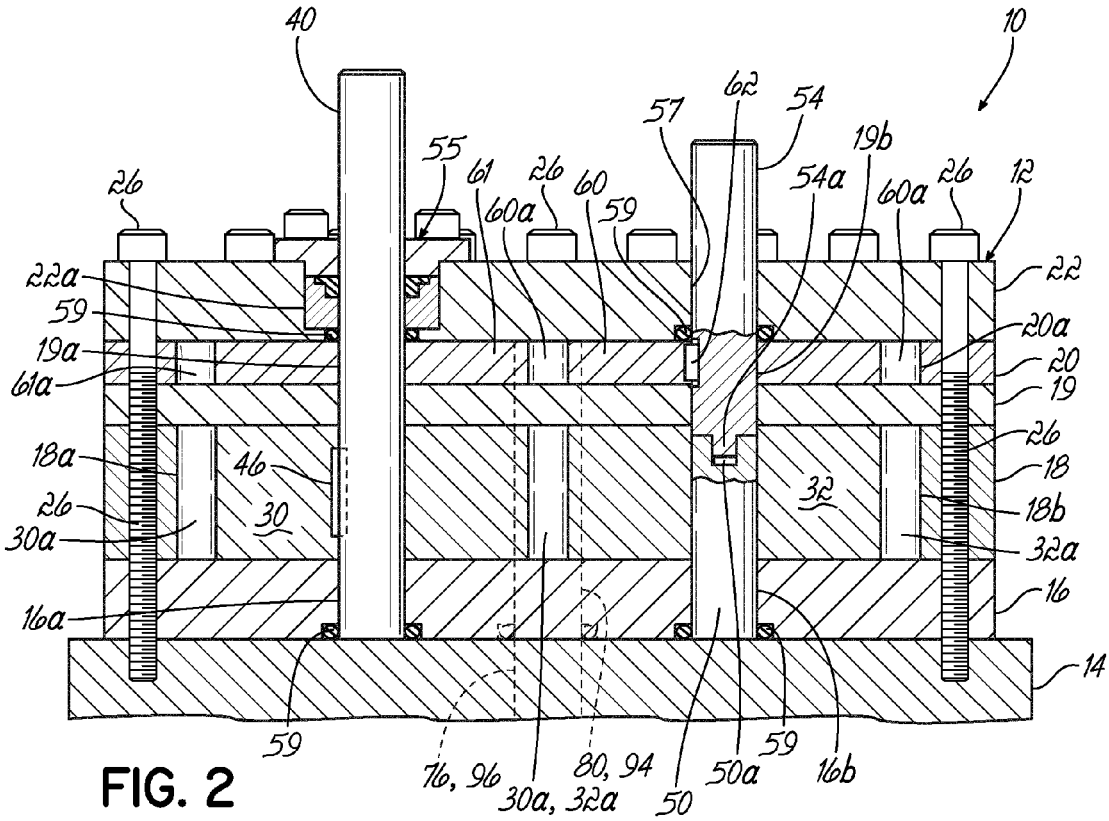
FIG. 2 is a cross sectional view of the gear pump shown in FIG. 1.
Figure 3:
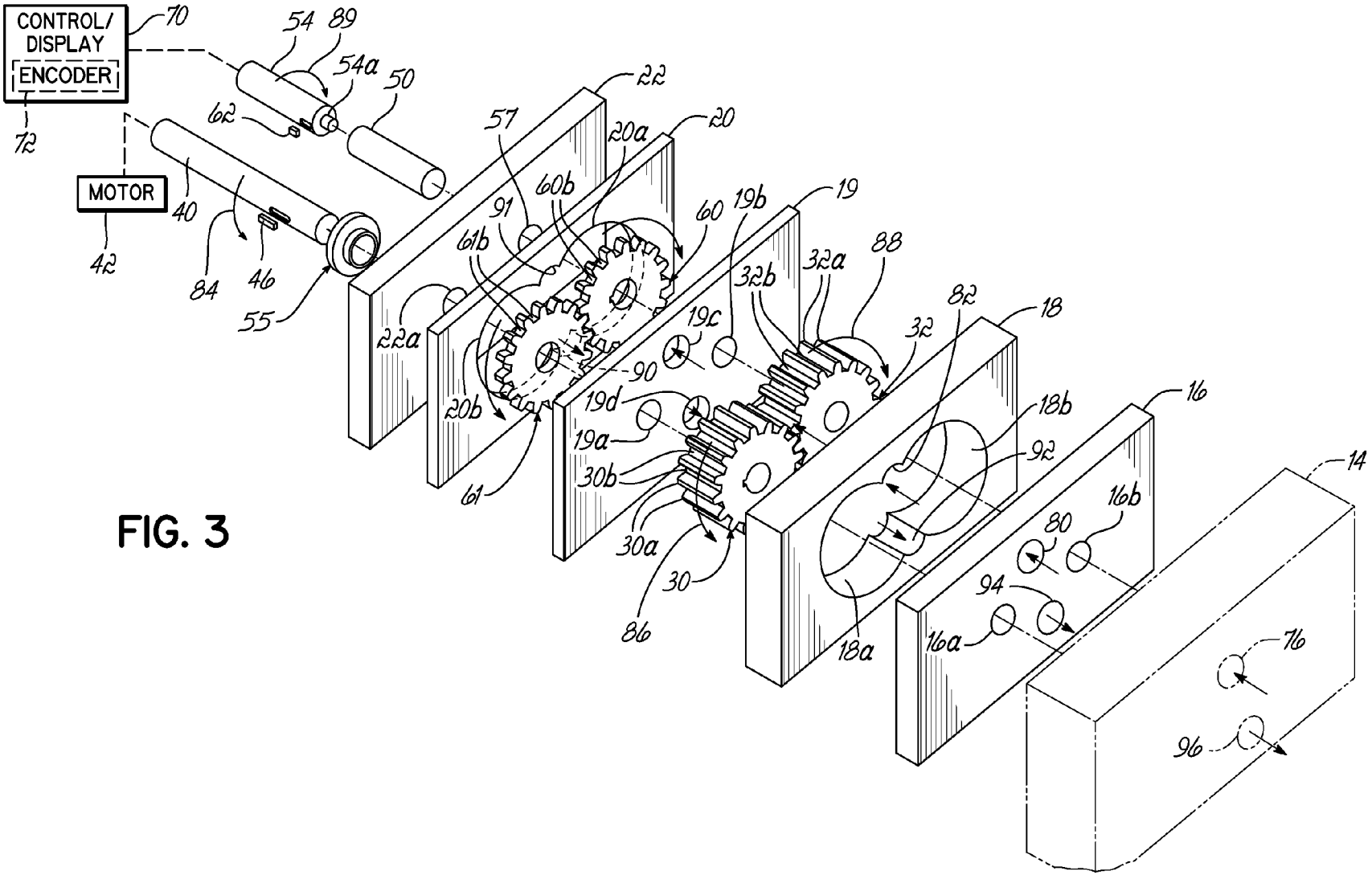
FIG. 3 is an exploded perspective view of the gear pump shown in FIG. 1.

A first embodiment of a metering gear pump system 10 is schematically shown in FIGS. 1-3. System 10 generally includes a metering gear pump 12 coupled for fluid communication with a manifold 14. The metering gear pump 12 includes a housing comprising, in this illustrative embodiment, a series of four stacked plates 16, 18, 19, 20, 22. Plates 16, 22 comprise end caps for the metering gear pump 12, while internal plates 18, 19, 20 receive the respective gears, as will be discussed below. Plates 16, 18, 19, 20, 22 are fastened together into a unitary assembly or housing by threaded fasteners 26. Plate 18 includes holes or cut-outs 18*a*, 18*b* that respectively contain a first, driven gear 30 and a second, idler gear 32. The gears 30, 32 have respective gear teeth 30*a*, 32*a* in meshing relationship with each other at a central, open area of the plate 18 where the holes 18*a*, 18*b* intersect. It will be appreciated that the inventive aspects described herein may be applied to many types of gear pumps, including more complex gear pumps than the examples given herein.

A drive shaft 40 is directly or indirectly coupled with a motor 42. The drive shaft 40 is further coupled to the driven gear 30 by a key 46. The idler gear 32 rotates freely about an idler shaft 50 and will be rotated by the driven gear 30 upon activation of the motor 42 due to the meshing relationship of the gear teeth 30*a*, 32*a*. The respective shafts 40, 50 are received for rotation in holes 16*a*, 16*b* of the plate 16. Idler shaft 50 is further coupled for rotation relative to a shaft 54. Drive shaft 40 is further received for rotation in a journal and seal assembly 55 secured within a hole 22*a* in plate 22 and a hole 19*a* in plate 19, and shaft 54 is received for rotation in a hole 57 in plate 22. Suitable dynamic seals 59 (schematically illustrated) are used to seal the shafts 40, 50, 54 and prevent leakage of fluid from the pump 12.

Shaft 54 is connected to a rotatable flow indicating element 60. In this embodiment, the flow indicating element is a gear 60 having gear teeth 60*a*. However, the flow indicating element may take other forms of rotatable elements that function as generally described herein. Flow indicating gear 60 is coupled to shaft 54 by a key 62. Shaft 54 is operatively coupled to a control 70 for indicating rotation of the shaft 54 and the attached flow indicating gear 60 to operating personnel. The control 70 may comprise or include an encoder 72 that will detect the rotational speed of the shaft 54 and provide an electronic output indicating that rotational speed. Because shaft 54 is physically connected for rotation with the flow indicating gear 60, the encoder 72 will likewise be indicating the rotational speed of the flow indicating gear 60 for purposes to be described further below. Shaft 54 is coupled to shaft 50 by a cylindrical pin 54*a* contained in a cylindrical blind bore 50*a* in the end of shaft 50. This connection allows free and independent rotation of the two shafts 50, 54 relative to each other.

The embodiment of FIGS. 1-3 further illustrates a second idler gear 61 that is meshing with gear 60 and rotates with respect to drive shaft 40. Gear 61 is not physically keyed or otherwise connected for rotation with drive shaft 40. It will be appreciated that in certain cases, only a single flow indicating element such as gear 60 will be necessary. Plate 20 includes a pair of holes or cut-outs 20*a*, 20*b* for respectively receiving gears 60, 61. Plate 19 is situated between plate 18 and plate 20 and includes holes 19*a*, 19*b* for respectively receiving shafts 40, 54, and 19*c*, 19*d* respectively in fluid communication with ports 80, 94 of plate 16 (further described below).

Based on a review of FIGS. 2 and 3, it will be appreciated that fluid under pressure is supplied from a supply port 76 of the manifold 14 through an inlet port 80 in the plate 16 and into an inlet space 82 between the two gears 30, 32. When the motor 42 rotates the drive shaft 40 in the direction shown by arrow 84 (FIG. 3), the meshing gears 30, 32 will rotate in opposite directions as shown by arrows 86, 88. This will create a void or vacuum in the inlet space 82 between the meshing gears 30, 32. This inlet space 82 is in communication with the spaces 60*b* between the gear teeth 60*a* of the flow indicating gear 60. The spaces 60*b* between the teeth 60*a* also communicate with the spaces 32*b* between the teeth 32*a* of the idler gear 32. As the gears 30, 32 are rotated upon activation of the motor 42, fluid will be carried by the gear tooth spaces 30*b*, 32*b* in the respective holes 18*a*, 18*b* of plate 18, as well as in the gear tooth spaces 60*b*, 61*b* in the holes 20*a*, 20*b* of plate 20. In this manner, the fluid is directed under pressure from an inlet space 91 to an outlet space 90 in plate 20 as well as an adjacent and communicating outlet space 92 in plate 18. The fluid is then forced through the outlet spaces 90, 92 and through a communicating outlet port 94 of plate 16 and a communicating port 96 of the manifold 14 where it is then delivered downstream to further system components (not shown).

As the fluid is moving through the pump 12 in the described manner, the flow indicating gear 60 and the attached shaft 54 will rotate in the direction of arrow 89 (FIG. 3) at a speed that is proportional to the flow rate of the fluid through the pump 12. This is due to the fluid pressure and the fluid movement around the idler gear 32 and the flow indicating gear 60. The control 70 will detect the speed of rotation of shaft 54, which is equal to the speed of rotation of the flow indicating gear 60. If the detected speed is lower than a predetermined level that has been previously determined as indicative of a pre-set metering rate, then the operating personnel are alerted and/or the system may automatically shut down (e.g., motor 42 may be stopped) so that troubleshooting and maintenance may be performed. The alerts may, for example, include one or more lights or audible alarms operatively associated with the control 70.

While the present invention has been illustrated by a description of various preferred embodiments and while these embodiments have been described in some detail, it is not the intention of the Applicants to restrict or in any way limit the scope of the appended claims to such detail. Additional advantages and modifications will readily appear to those skilled in the art. The various features of the invention may be used alone or in any combination depending on the needs and preferences of the user. This has been a description of the present invention, along with the preferred methods of practicing the present invention as currently known. However, the invention itself should only be defined by the appended claims.

What is claimed is:

1. A gear pump for metering viscous fluid, comprising:

a housing including an inlet port for receiving the viscous fluid and an outlet port for discharging the viscous fluid;

a driven gear and an idler gear each mounted for rotation in said housing, said driven gear and said idler gear including respective gear teeth in a meshing relationship and forming an inlet space and an outlet space in the housing and adjacent to the meshing gear teeth, said inlet space being in fluid communication with said inlet port and said outlet space being in fluid communication with said outlet port; and a flow indicating element located in said housing and mounted for rotation independent of said driven gear and said idler gear, said flow indicating element configured to be rotated by the viscous fluid to indicate when the fluid is moving from said inlet port and inlet space to said outlet space and outlet port.

2. The gear pump of claim 1, further comprising:

an electronic control coupled to said flow indicating element and operable to indicate rotation of said flow indicating element to a user.

3. The gear pump of claim 2, wherein said electronic control further comprises an encoder.

4. The gear pump of claim 1, wherein said flow indicating element further comprises a flow indicating gear.

5. The gear pump of claim 4, wherein said flow indicating gear is mounted for rotation coaxially relative to at least one of the driven gear or the idler gear.

6. The gear pump of claim 1, wherein said housing further comprises a plurality of stacked plates, said driven gear and said idler gear being mounted for rotation in one of said stacked plates and said flow indicating element further comprising a flow indicating gear mounted in an another of said stacked plates.

7. A gear pump for metering viscous fluid, comprising:

a housing including an inlet port for receiving the viscous fluid and an outlet port for discharging the viscous fluid;

a driven gear and an idler gear each mounted for rotation in said housing, said driven gear and said idler gear including respective gear teeth in a meshing relationship and forming an inlet space and an outlet space in the housing and adjacent to the meshing gear teeth, said inlet space being in fluid communication with said inlet port and said outlet space being in fluid communication with said outlet port;

a flow indicating gear located in said housing and mounted for rotation independent of said driven gear and said idler gear, said flow indicating gear configured to be rotated by the viscous fluid to indicate when the fluid is moving from said inlet port and inlet space to said outlet space and outlet port; and an encoder coupled to said flow indicating gear and operable to indicate rotation of said flow indicating element to a user.

8. The gear pump of claim 7, wherein said flow indicating gear is mounted for rotation coaxially relative to at least one of the driven gear or the idler gear.

9. The gear pump of claim 7, wherein said housing further comprises a plurality of stacked plates, said driven gear and said idler gear being mounted for rotation in one of said stacked plates and said flow indicating mounted in an another of said stacked plates.

10. A method of indicating flow of viscous fluid through a gear pump, comprising:

supplying the viscous fluid to an inlet port of a housing;

driving a first gear in meshing relation with a second gear, each mounted for rotation in the housing to move the viscous fluid from the inlet port to an inlet space adjacent the meshing first and second gears and to an outlet space adjacent the meshing first and second gears and an outlet port of the housing; and rotating a flow indicating element located in the housing by movement of the viscous fluid from the inlet port and inlet space to the outlet space and outlet port.

11. The method of claim 10, further comprising:

indicating rotation of the flow indicating element to a user through an electronic control operatively coupled to the flow indicating element.

12. The method of claim 10, further comprising:

indicating rotation of the flow indicating element to a user through an encoder operatively coupled to the flow indicating element.

13. The method of claim 10, wherein rotating the flow indicating element further comprises rotating a flow indicating gear.

14. The method of claim 13, wherein rotating the flow indicating gear further comprises rotating the flow indicating gear coaxially relative to at least one of the first or second gears.

* * * * *

UNITED STATES PATENT AND TRADEMARK OFFICE

CERTIFICATE OF CORRECTION

PATENT NO. : 8,496,457 B2
APPLICATION NO. : 13/285514
DATED : July 30, 2013
INVENTOR(S) : Leslie J. Varga It is certified that error appears in the above-identified patent and that said Letters Patent is hereby corrected as shown below:

In the Claims

Column 5

Claim 6, line 8, delete “an”.

Column 6

Claim 9, line 4, after “indicating” insert --gear--.

Claim 9, line 4, delete “an”.

Signed and Sealed this
Fifth Day of November, 2013

Teresa Stanek Rea
*Deputy Director of the United States Patent and Trademark Office*